US006595468B1

(12) United States Patent
Chang

(10) Patent No.: US 6,595,468 B1
(45) Date of Patent: Jul. 22, 2003

(54) KITE DEVICE

(76) Inventor: Chin-Chuan Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/285,877

(22) Filed: Oct. 25, 2002

(51) Int. Cl.[7] ..... A63H 27/08; B64C 31/06

(52) U.S. Cl. ..... 244/153 R; 244/155 R; D21/445; D21/446

(58) Field of Search ..... 244/153 R, 155 R, 244/153 A; D21/445, 446

(56) References Cited

U.S. PATENT DOCUMENTS 743,301 A * 11/1903 Lischtiak ..... 244/153 R
2,941,765 A * 6/1960 Feldman ..... 244/153 R
5,524,851 A * 6/1996 Huang ..... 244/153 R
6,315,246 B1 * 11/2001 Wu et al. ..... 244/153 R

* cited by examiner

*Primary Examiner*—J. Woodrow Eldred

(57) ABSTRACT

A kite device has an animal pattern, a pair of round holes, two pairs of sockets, and a pair of eye-shaped rotating devices. Each pair of the sockets are adjacent to the corresponding round holes of the kite device. Each of the eye-shaped rotating devices has a shaft, a-first disk, and a second disk. The first disk has a pair of periphery grooves. The second disk has a pair of periphery recesses to match the periphery grooves of the first disk. The first disk engages with the second disk. The shaft passes through the periphery recesses of the second disk and the periphery grooves of the first disk. Each of the eye-shaped rotating devices is inserted in the corresponding round hole of the kite device. Each shaft engages with the corresponding pair of sockets.

2 Claims, 5 Drawing Sheets

KITE DEVICE

BACKGROUND OF THE INVENTION

The present invention relates to a kite. More particularly, the present invention relates to a kite device which has a pair of eye-shaped rotating devices.

A conventional kite has a spine adhered on a cover sheet. A tail band is connected to the spine. However, the conventional kite cannot be detached.

SUMMARY OF THE INVENTION

An object of the present invention is to provide a kite device which has a pair of eye-shaped rotating devices to be rotated by a wind.

Another object of the present invention is to provide a kite device which has a pair of eye-shaped rotating devices to be painted in order to attract people.

Accordingly, a kite device comprises an animal pattern, a pair of round holes, two pairs of sockets, and a pair of eye-shaped rotating devices. Each pair of the sockets are adjacent to the corresponding round holes of the kite device. Each of the eye-shaped rotating devices has a shaft, a, first disk, and a second disk. The first disk has a pair of periphery grooves. The second disk has a pair of periphery recesses to match the periphery grooves of the first disk. The first disk engages with the second disk. The shaft passes through the periphery recesses of the second disk and the periphery grooves of the first disk. Each of the eye-shaped rotating devices is inserted in the corresponding round hole of the kite device. Each shaft engages with the corresponding pair of sockets.

BRIEF DESCRIPTION OF THE DRAWINGS

FIG. 4A is a schematic view illustrating an eye-shaped rotating device disposed on a kite device of a preferred embodiment in accordance with the present invention; and.

DETAILED DESCRIPTION OF THE INVENTION

Figure 1:
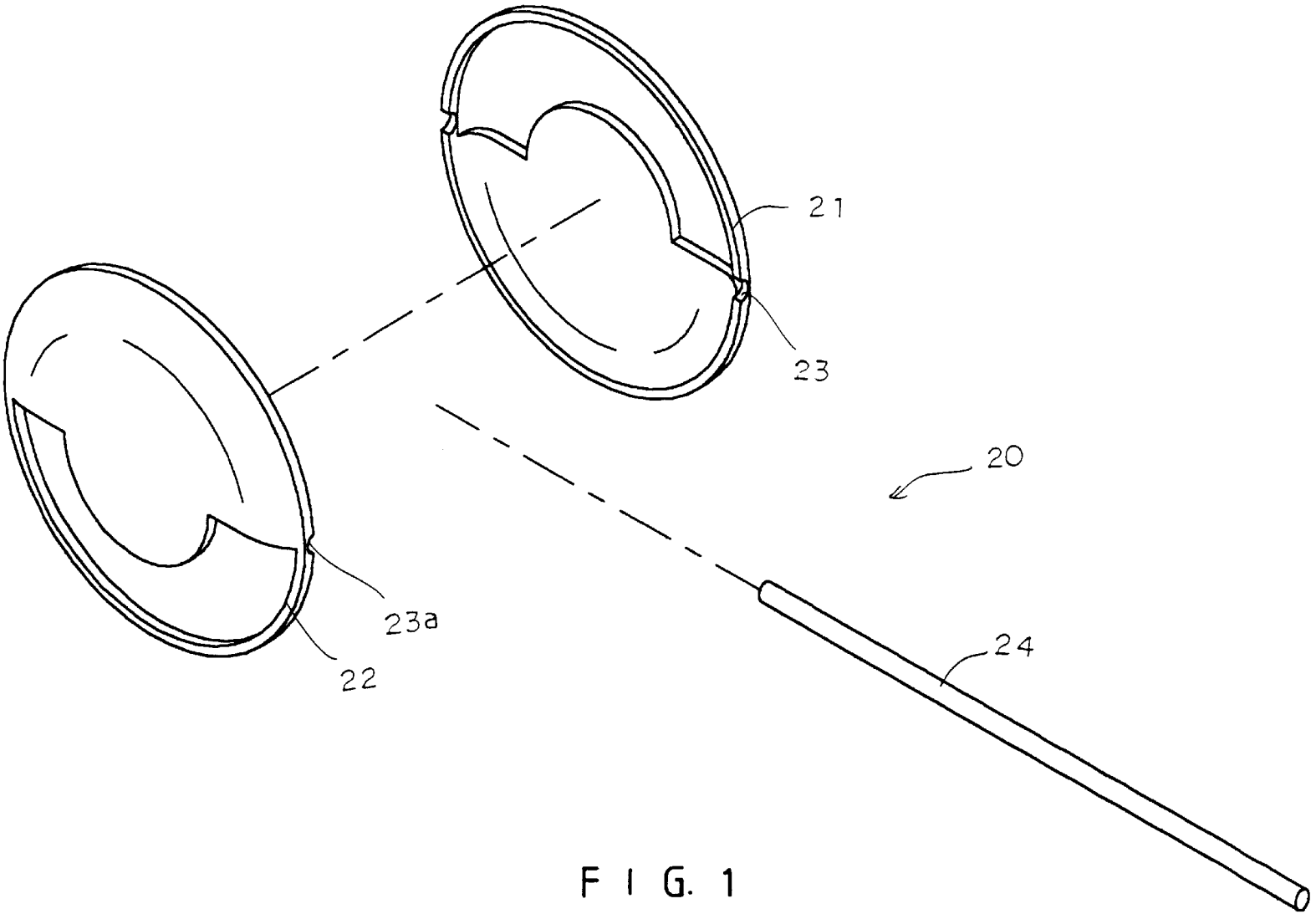
FIG. 1 is a perspective exploded view of an eye-shaped rotating device of a preferred embodiment in accordance with the present invention.
Figure 2:
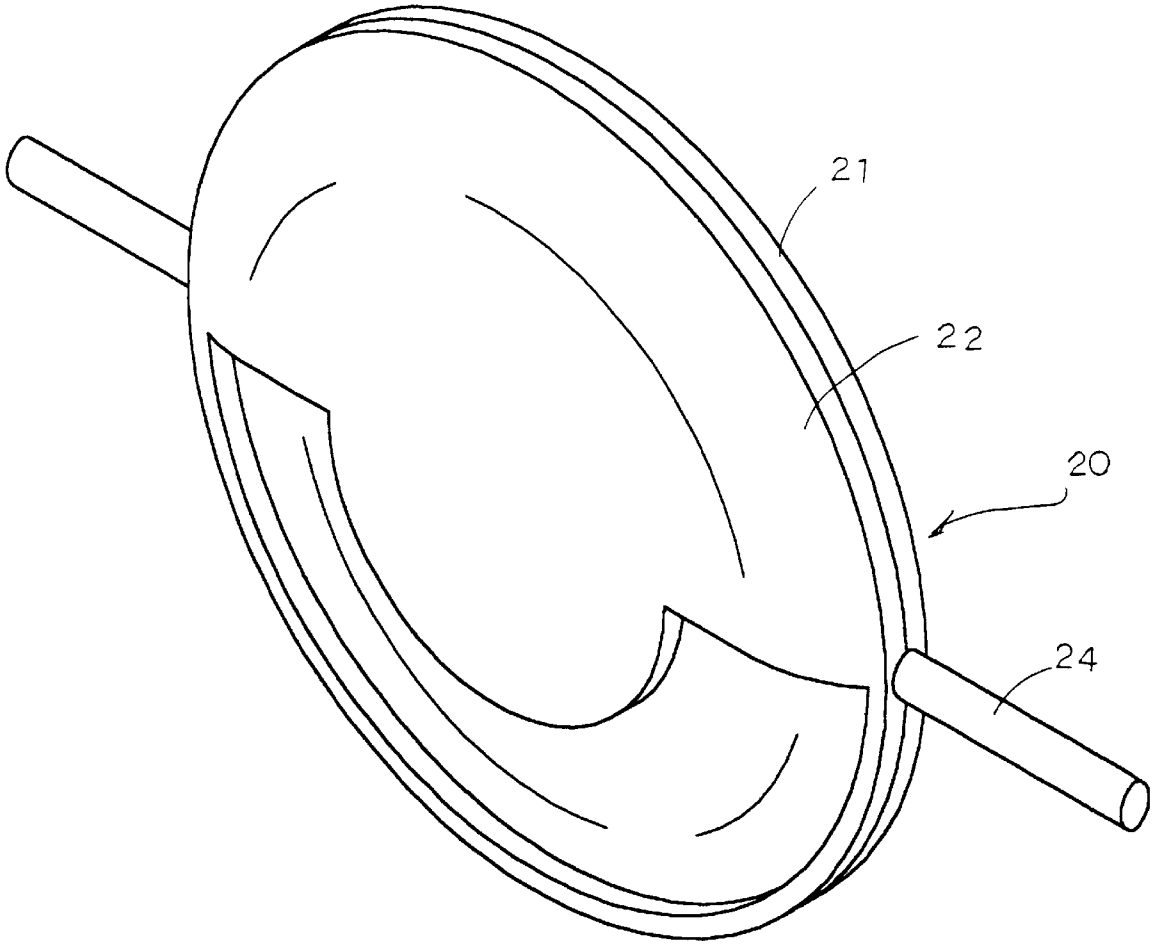
FIG. 2 is a perspective assembly view, of an eye-shaped rotating device of a preferred embodiment in accordance with the present invention.
Figure 3:
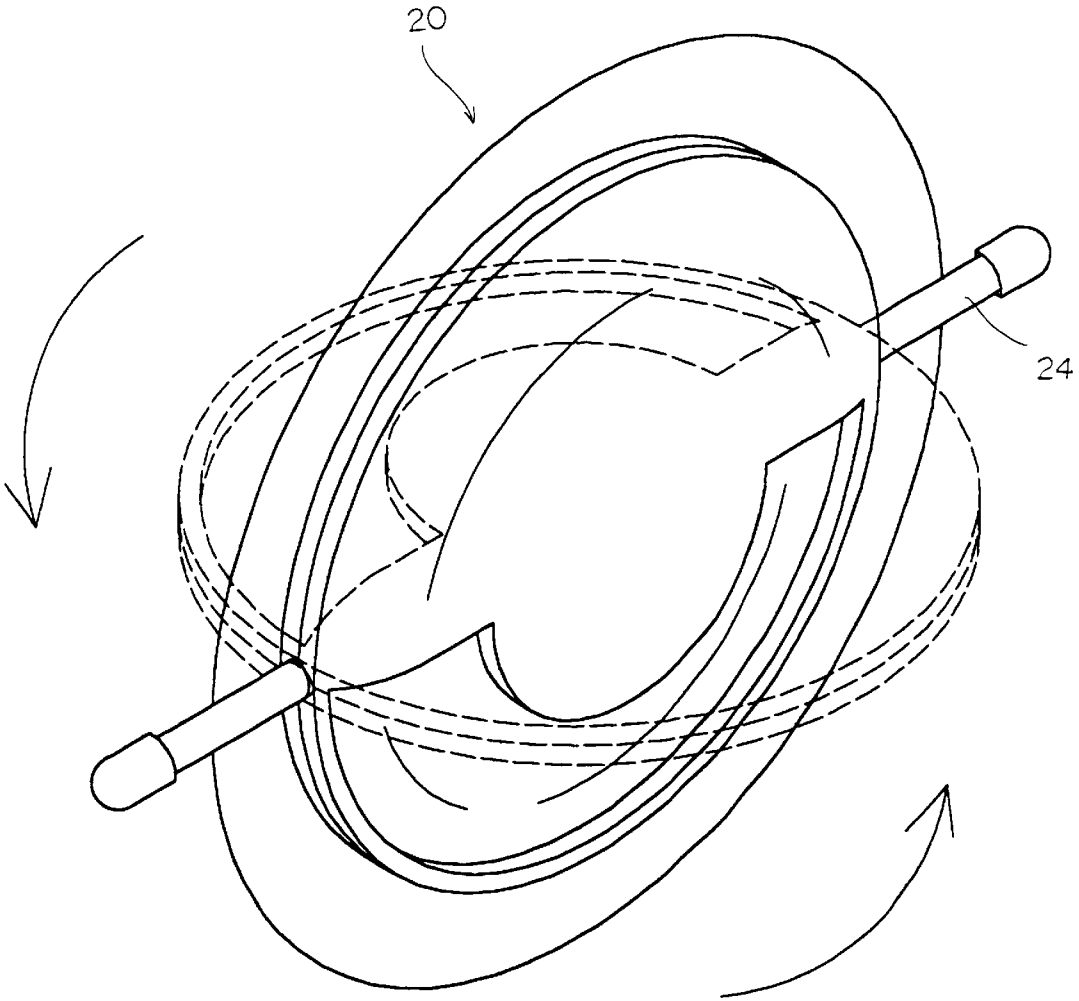
FIG. 3 is a schematic view illustrating an operation of an eye-shaped rotating device of a preferred embodiment in accordance with the present invention.
Figure 4A:
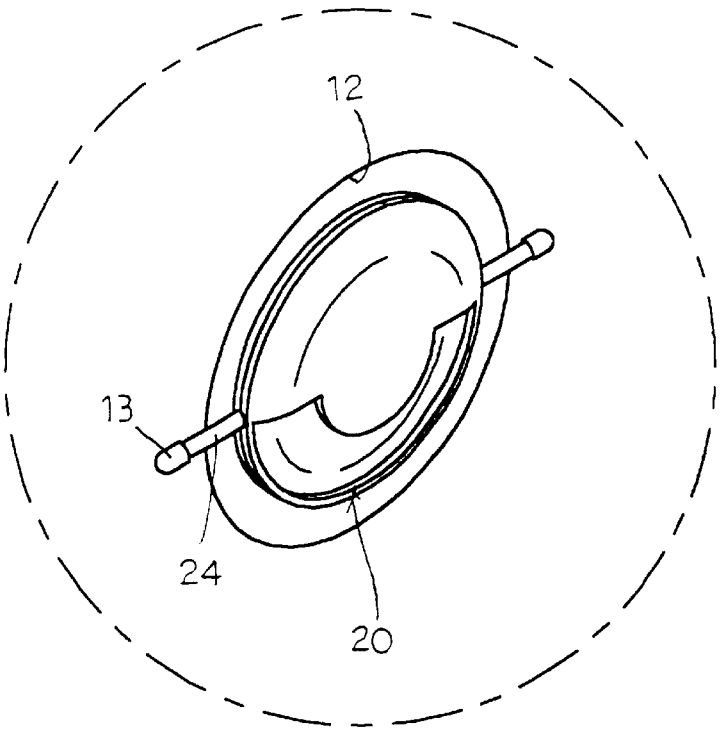
Figure 4:
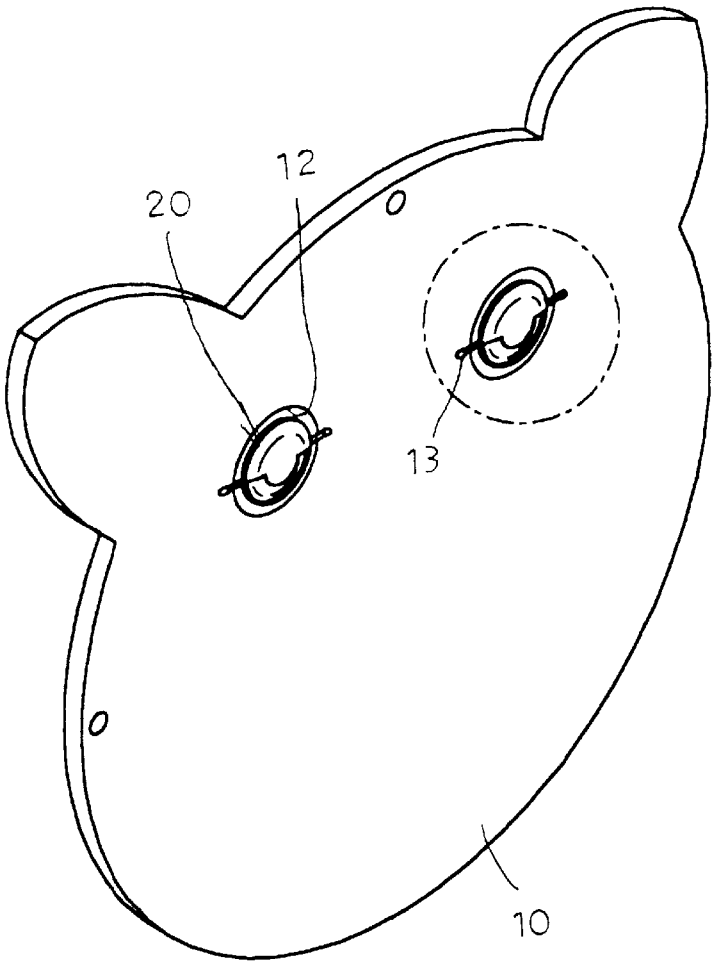
FIG. 4 is a perspective view of a kite device of a preferred embodiment in accordance with the present invention.
Figure 5:
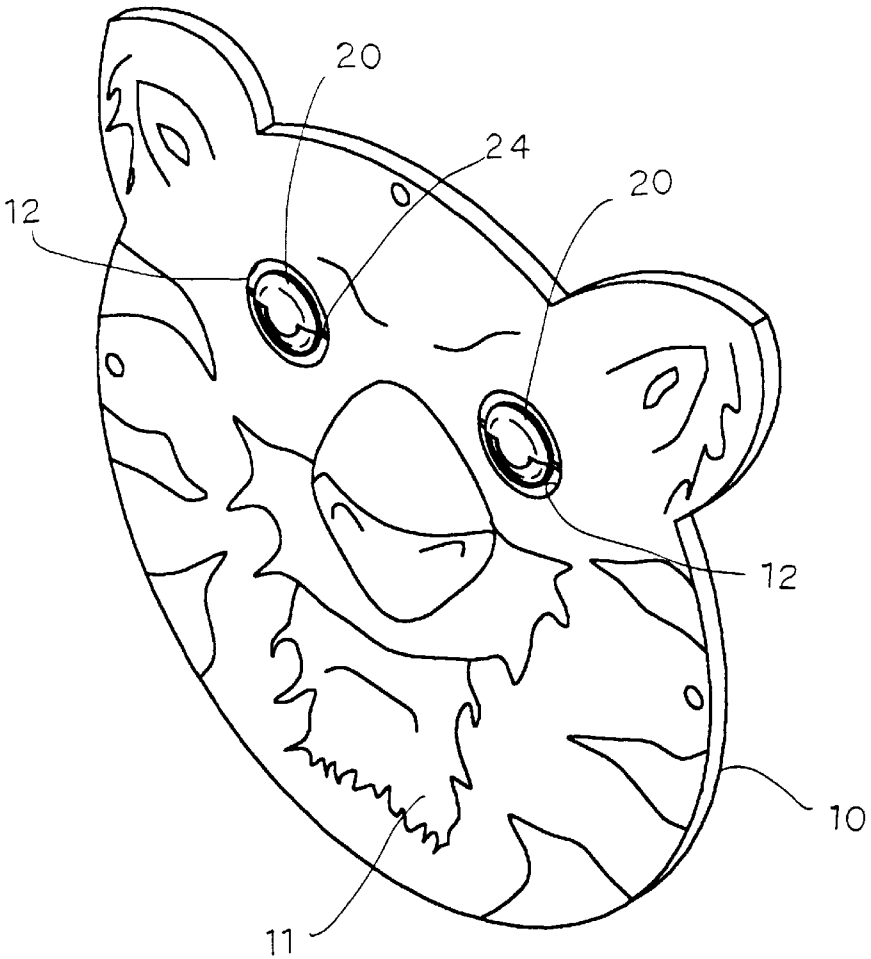
FIG. 5 is another perspective view of a kite device of a preferred embodiment in accordance with the present invention.

Referring to FIGS. 1 to 5, a kite device 10 comprises an animal pattern 11, a pair of round holes 12, two pairs of sockets 13, and a pair of eye-shaped rotating devices 20.

Each pair of the sockets 13 are adjacent to the corresponding round holes 12 of the kite device 10.

Each of the eye-shaped rotating devices 20 has a shaft 24, a first disk 21, and a second disk 22.

The first disk 21 has a pair of periphery grooves 23.

The second disk 22 has a pair of periphery recesses 23*a* to match the periphery grooves 23 of the first disk 21.

The first disk 21 engages with the second disk 22.

The shaft 24 passes through the periphery recesses 23*a* of the second disk 22 and the periphery grooves 23 of the first disk 21.

Each of the eye-shaped rotating devices 20 is inserted in the corresponding round hole 12 of the kite device 10.

Each shaft 24 engages with the corresponding pair of sockets 13.

It is an option to paint the eye-shaped rotating devices 20 with various colors in order to attract people.

The present invention is not limited to the above embodiments but various modification thereof may be made. Furthermore, various changes in form and detail may be made without departing from the scope of the present invention.

I claim:

1. A kite device comprises:

an animal pattern, a pair of round holes, two pairs of sockets, and a pair of eye-shaped rotating devices, each said pair of the sockets adjacent to the corresponding round holes of the kite device, each of the eye-shaped rotating devices having a shaft, a first disk, and a second disk, the first disk having a pair of periphery grooves, the second disk having a pair of periphery recesses to match the periphery grooves of the first disk, the first disk engaging with the second disk, the shaft passing through the periphery recesses of the second disk and the periphery grooves of the first disk, each of the eye-shaped rotating devices inserted in the corresponding round hole of the kite device, and each said shaft engaging with the corresponding pair of sockets.

2. The kite device as claimed in claim 1, wherein the eye-shaped rotating devices are painted.

* * * * *